US008857959B2

(12) United States Patent
Ishida et al.

(10) Patent No.: US 8,857,959 B2
(45) Date of Patent: Oct. 14, 2014

(54) INKJET RECORDING APPARATUS

(71) Applicant: Brother Kogyo Kabushiki Kaisha, Nagoya (JP)

(72) Inventors: Kazuhito Ishida, Ichinomiya (JP); Masahisa Kato, Kariya (JP); Tomofumi Murano, Nagoya (JP); Ryohei Suzuki, Nagoya (JP); Tomohisa Higuchi, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/038,730

(22) Filed: Sep. 26, 2013

(65) Prior Publication Data

US 2014/0168323 A1 Jun. 19, 2014

(30) Foreign Application Priority Data

Dec. 14, 2012 (JP) ..... 2012-273897

(51) Int. Cl.
*B41J 2/175* (2006.01)

(52) U.S. Cl.
CPC ..... *B41J 2/17513* (2013.01)
USPC ..... 347/86

(58) Field of Classification Search
USPC ..... 347/84–86
See application file for complete search history.

(56) References Cited

U.S. PATENT DOCUMENTS

| | | | | |
|---|---|---|---|---|
| 6,203,138 | B1 * | 3/2001 | Hirabayashi et al. | 347/86 |
| 6,281,911 | B1 * | 8/2001 | Nakazawa et al. | 347/86 |
| 8,602,522 | B2 * | 12/2013 | Harada et al. | 347/86 |
| 2009/0218270 | A1 | 9/2009 | Harada | |
| 2009/0218271 | A1 | 9/2009 | Harada | |
| 2009/0219337 | A1 | 9/2009 | Harada et al. | |
| 2009/0219338 | A1 | 9/2009 | Harada | |
| 2009/0219339 | A1 | 9/2009 | Harada | |
| 2012/0234436 | A1 | 9/2012 | Harada et al. | |
| 2012/0236074 | A1 | 9/2012 | Harada et al. | |

FOREIGN PATENT DOCUMENTS

| | | |
|---|---|---|
| JP | 2009-269208 A | 11/2009 |
| JP | 2012-196799 A | 10/2012 |

* cited by examiner

*Primary Examiner* — Kristal Feggins
(74) *Attorney, Agent, or Firm* — Merchant & Gould PC

(57) ABSTRACT

An inkjet recording apparatus, including a first casing having an upward opening at a top thereof; a recording unit disposed in the first casing and configured to discharge ink from a nozzle onto a sheet; a first cover to cover a part of the opening of the first casing; a second cover detachably attached to the first cover and configured to cover another part of the opening which is not covered by the first cover; a waste ink tank removably supported by the first casing at a position facing the second cover in the first casing and configured to contain waste ink discharged from the nozzle; and a second casing disposed in an upper position with respect to the first casing and configured to be movable between a proximate position and a separate position, is provided.

12 Claims, 10 Drawing Sheets

INKJET RECORDING APPARATUS

CROSS REFERENCE TO RELATED APPLICATION

This application claims priority from Japanese Patent Application No. 2012-273897, filed on Dec. 14, 2012, the entire subject matter of which is incorporated herein by reference.

BACKGROUND

1. Technical Field

An aspect of the present invention relates to an inkjet recording apparatus having a waste ink tank to store waste ink discharged from a nozzle.

2. Related Art

Conventionally, an inkjet recording apparatus for recording an image on a sheet by discharging ink from nozzles of a recording head onto the sheet is known. In such an inkjet recording apparatus, while the ink is lead in ink channels to the nozzles of the recording head, obstacles such as ink clots may clog in the ink channels and may interfere with discharge of the ink from the nozzles. In order to remove the obstacles from the nozzles of the recording head, a maintenance unit may be provided in the inkjet recording apparatus. The maintenance unit may have a pump to suck the obstacles from the nozzles and a reservoir tank to store the discharged ink and the removed obstacles.

For example, a multi-function device (MFD) may be equipped with such a waste liquid container. The waste liquid container may be detachably attached to a lower-rear side of a body of the MFD, and a rear cover may cover a part of the waste liquid container. The waste liquid container may be exchangeable when the rear cover is removed from the body.

SUMMARY

Meanwhile, an MFD may often be placed in a position adjacent to a wall with a rear side thereof faced to the wall. Therefore, when the above-mentioned MFD is placed in such a position, and when a user intends to exchange the waste liquid container, it may be necessary that the user moves the MFD to create a work area in between the rear side of the MFD and the wall. Further, it may also be necessary to reserve an extra work area for the MFD to be moved therein to disconnect cables such as a power cable and a communication cable from the MFD. Thus, exchanging the waste containers may involve onerous works.

The present invention is advantageous in that an inkjet recording apparatus having an easily exchangeable waste ink tank is provided.

According to an aspect of the present invention, an inkjet recording apparatus is provided. The inkjet recording apparatus includes a first casing having an upward opening at a top thereof; a recording unit disposed in the first casing and configured to discharge ink from a nozzle onto a sheet; a first cover configured to cover a part of the opening of the first casing; a second cover detachably attached to the first cover and configured to cover another part of the opening which is not covered by the first cover; a waste ink tank removably supported by the first casing at a position facing the second cover in the first casing and configured to contain waste ink discharged from the nozzle; and a second casing disposed in an upper position with respect to the first casing and configured to be movably supported by the first cover, the second casing being movable between a proximate position, in which the second casing is adjacent to top planes of the first cover and the second cover, and a separate position, in which the second casing is separated from the top planes of the first cover and the second cover.

BRIEF DESCRIPTION OF THE ACCOMPANYING DRAWINGS

Figure 5A:
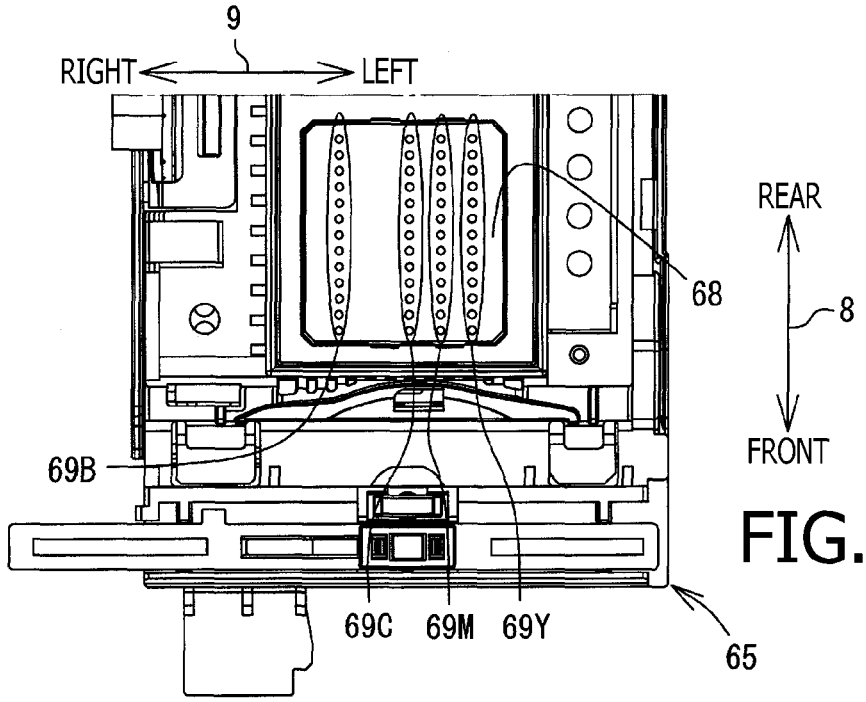
Figure 5B:
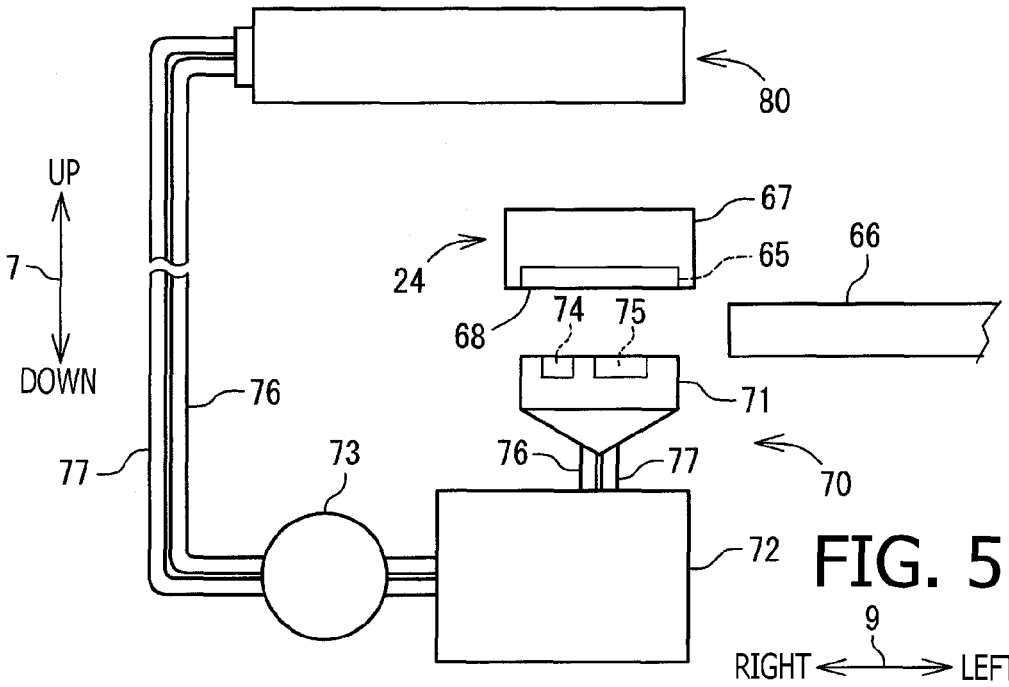

FIG. 5A is a plane view of a bottom of a recording head 65 in the MFD 10 according to the embodiment of the present invention. FIG. 5B is an illustrative view of a purging unit 70 and a waste ink tank 80 in the MFD 10 according to the embodiment of the present invention.

Figure 6:
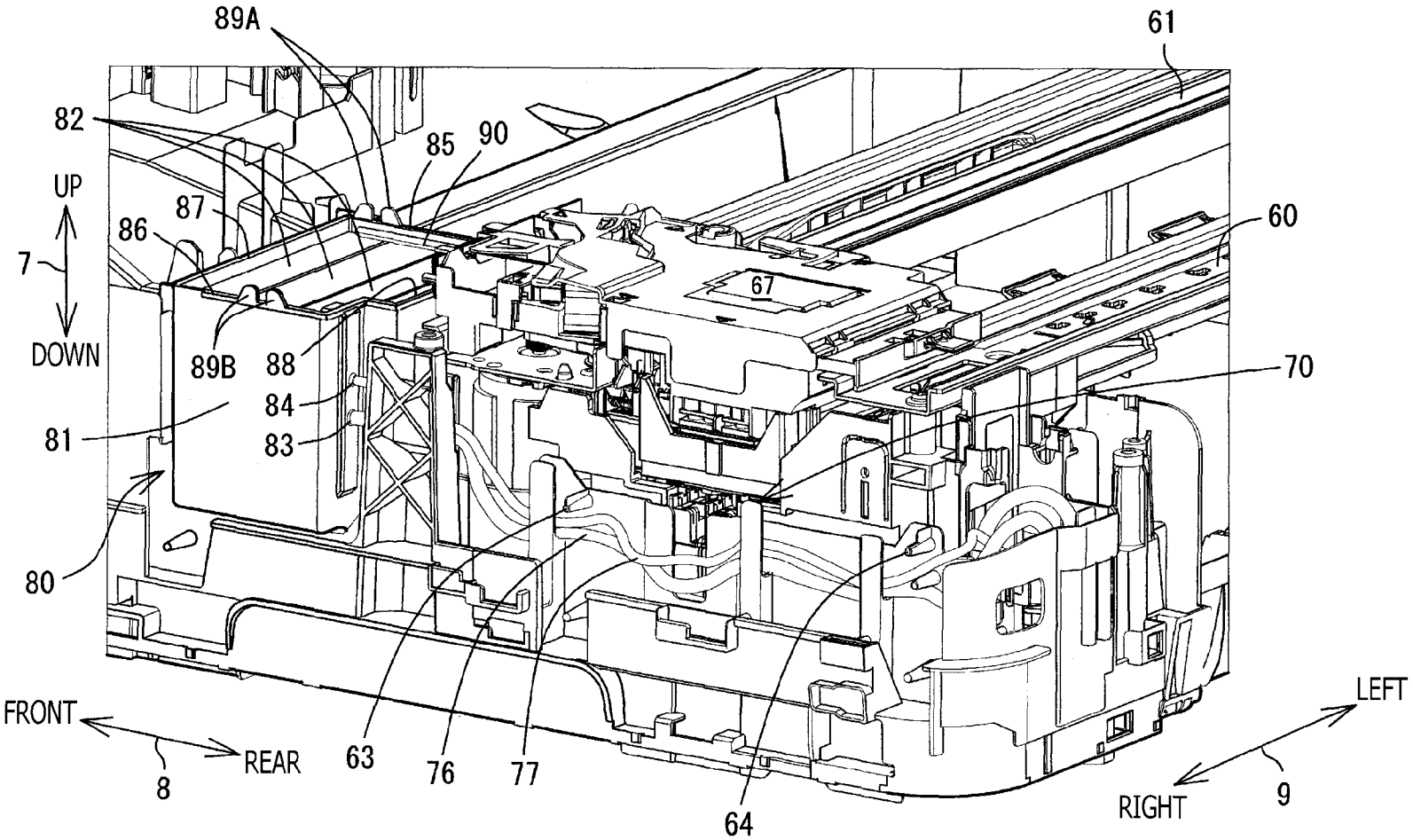

FIG. 6 is a perspective view of an internal structure of the MFD 10, including arrangement of tubes 76, 77, according to the embodiment of the present invention.

Figure 7:
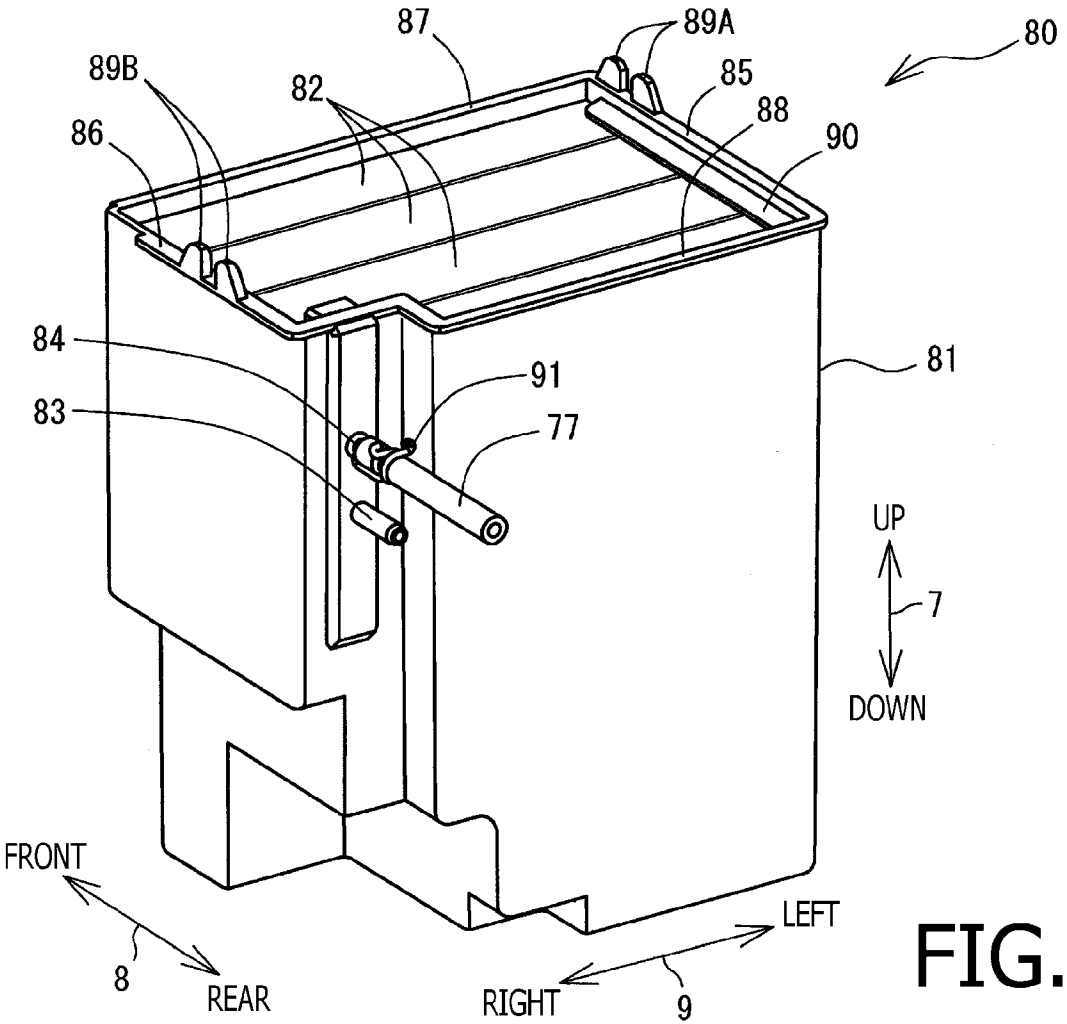

FIG. 7 is a perspective view of the waste ink tank 80 to be installed in the MFD 10 according to the embodiment of the present invention.

Figure 8:
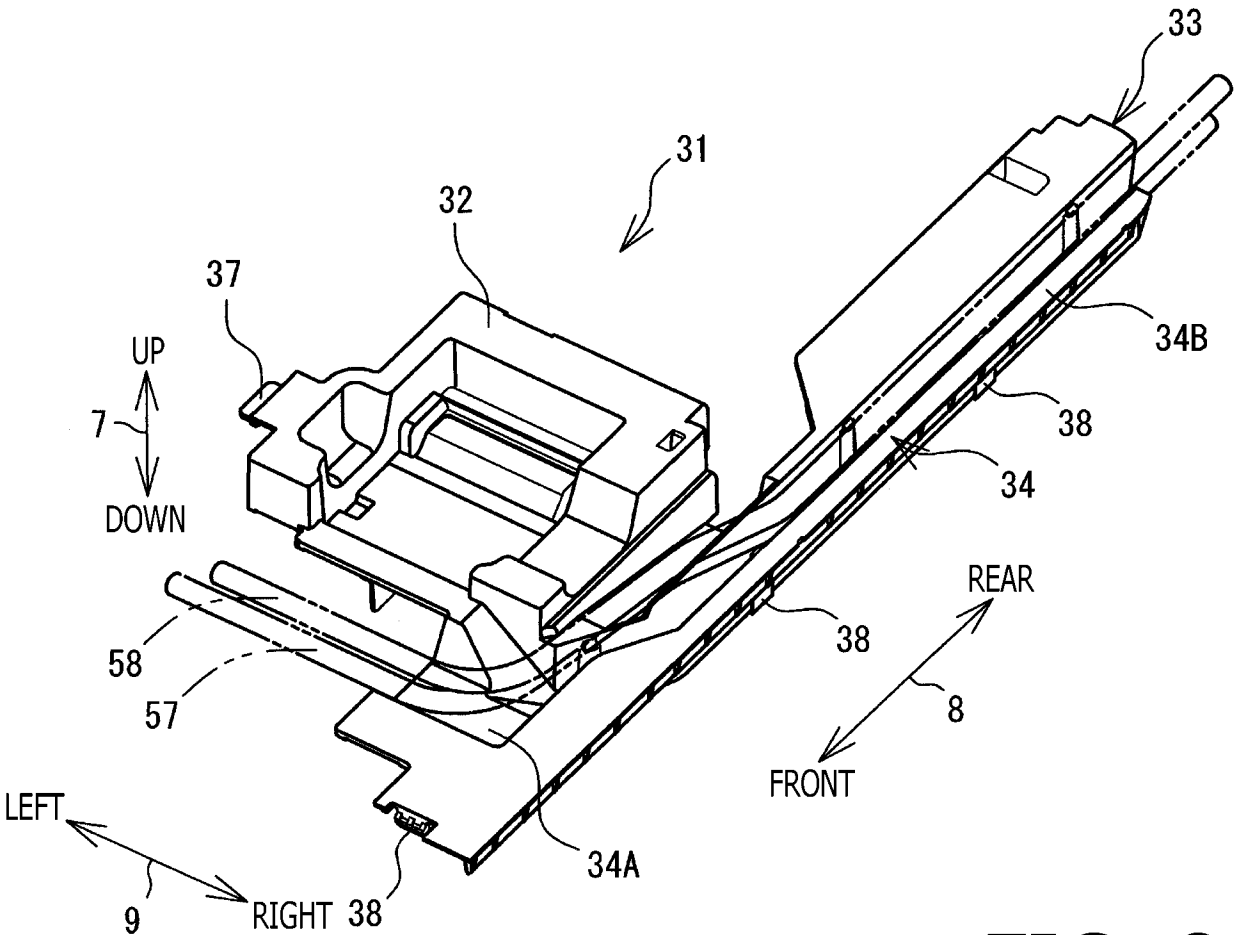

FIG. 8 is a perspective view of a second cover 31 with cables 57, 58 of the MFD 10 according to the embodiment of the present invention.

Figure 9:
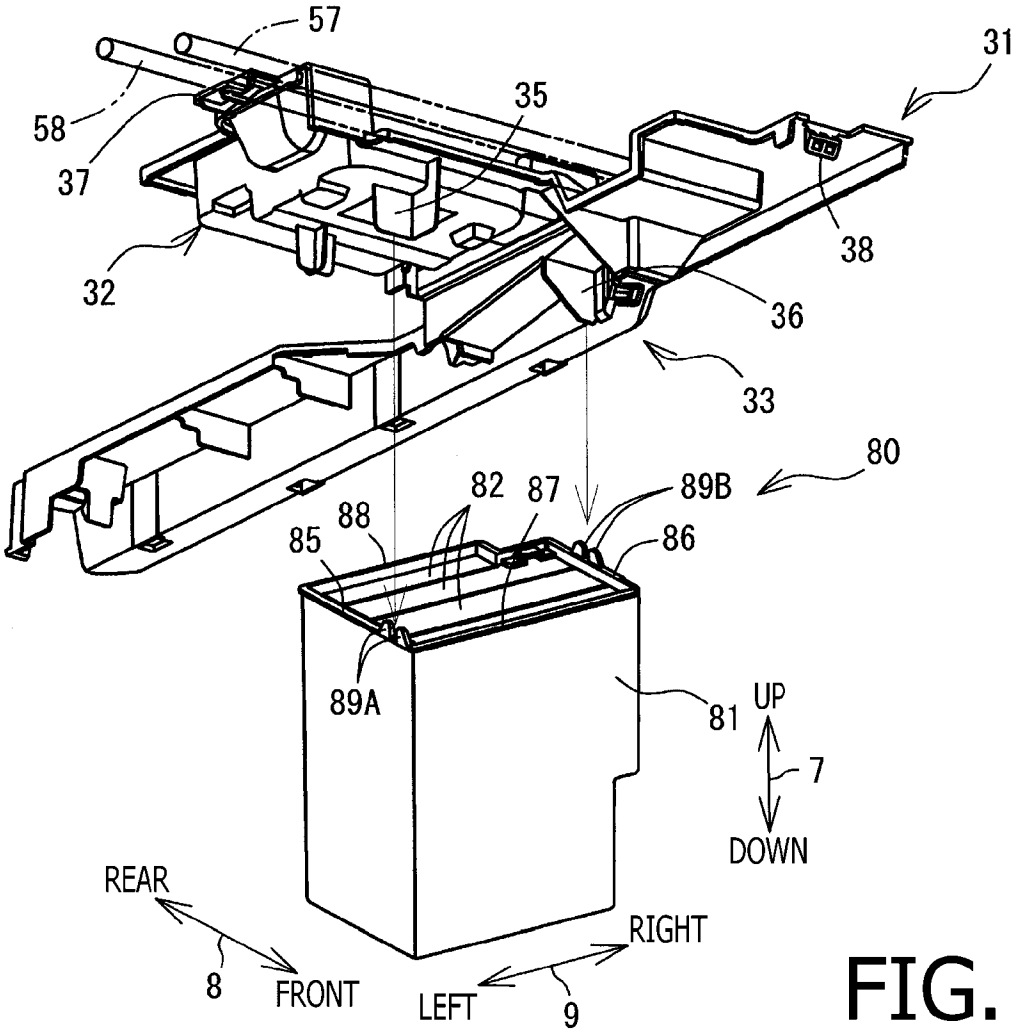

FIG. 9 is a perspective view of the second cover 31 and the waste ink tank 80 showing relative positions with respect to each other in the MFD 10 according to the embodiment of the present invention.

Figure 10C:
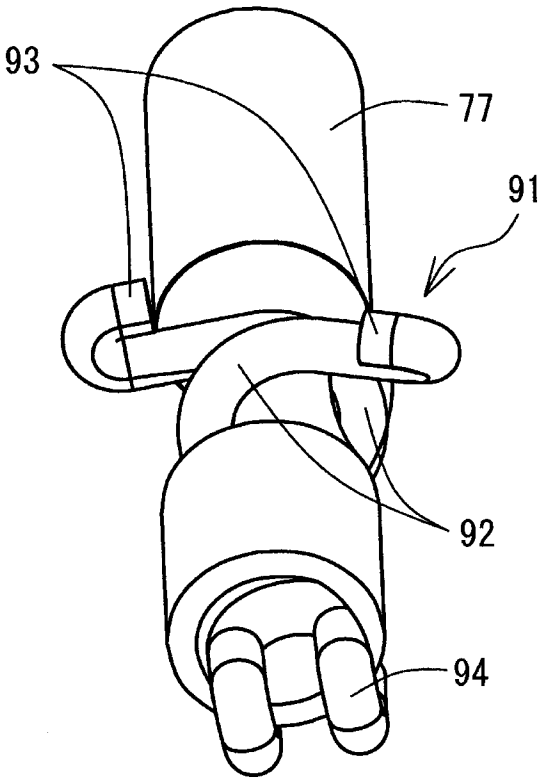
Figure 10B:
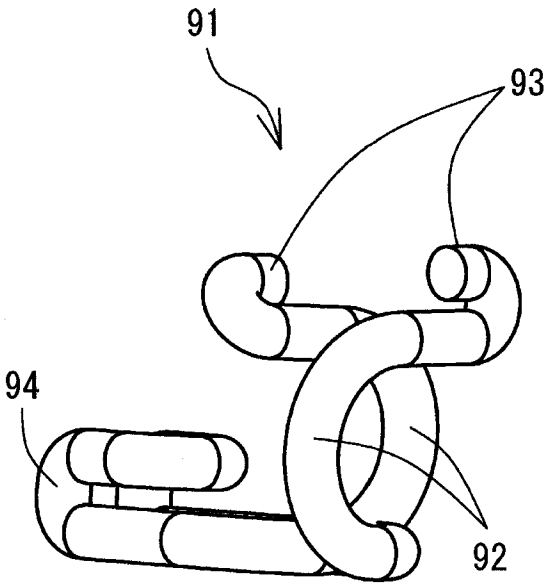
Figure 10A:
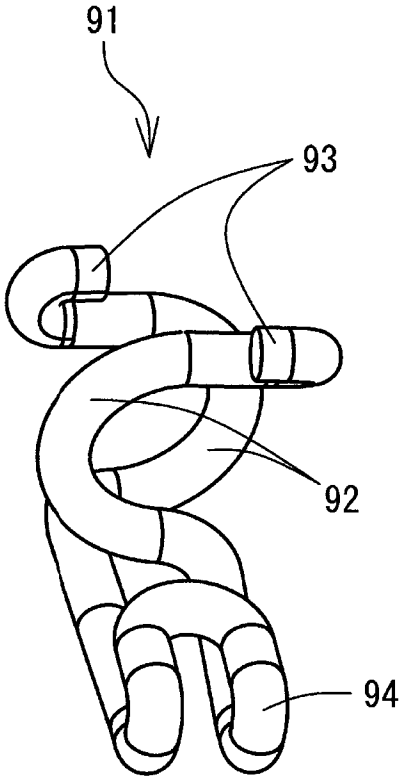

FIGS. 10A and 10B are perspective views of a fastening member 91 in the MFD 10 according to the embodiment of the present invention. FIG. 10C is a perspective view of the fastening member 91 attached to the tube 77 in the MFD 10 according to the embodiment of the present invention.

DETAILED DESCRIPTION

Hereinafter, an embodiment of the present invention will be described with reference to the accompanying drawings. It is noted that various connections are set forth between elements in the following description. These connections in general, and unless specified otherwise, may be direct or indirect, and this specification is not intended to be limiting in this respect.

Figure 1:
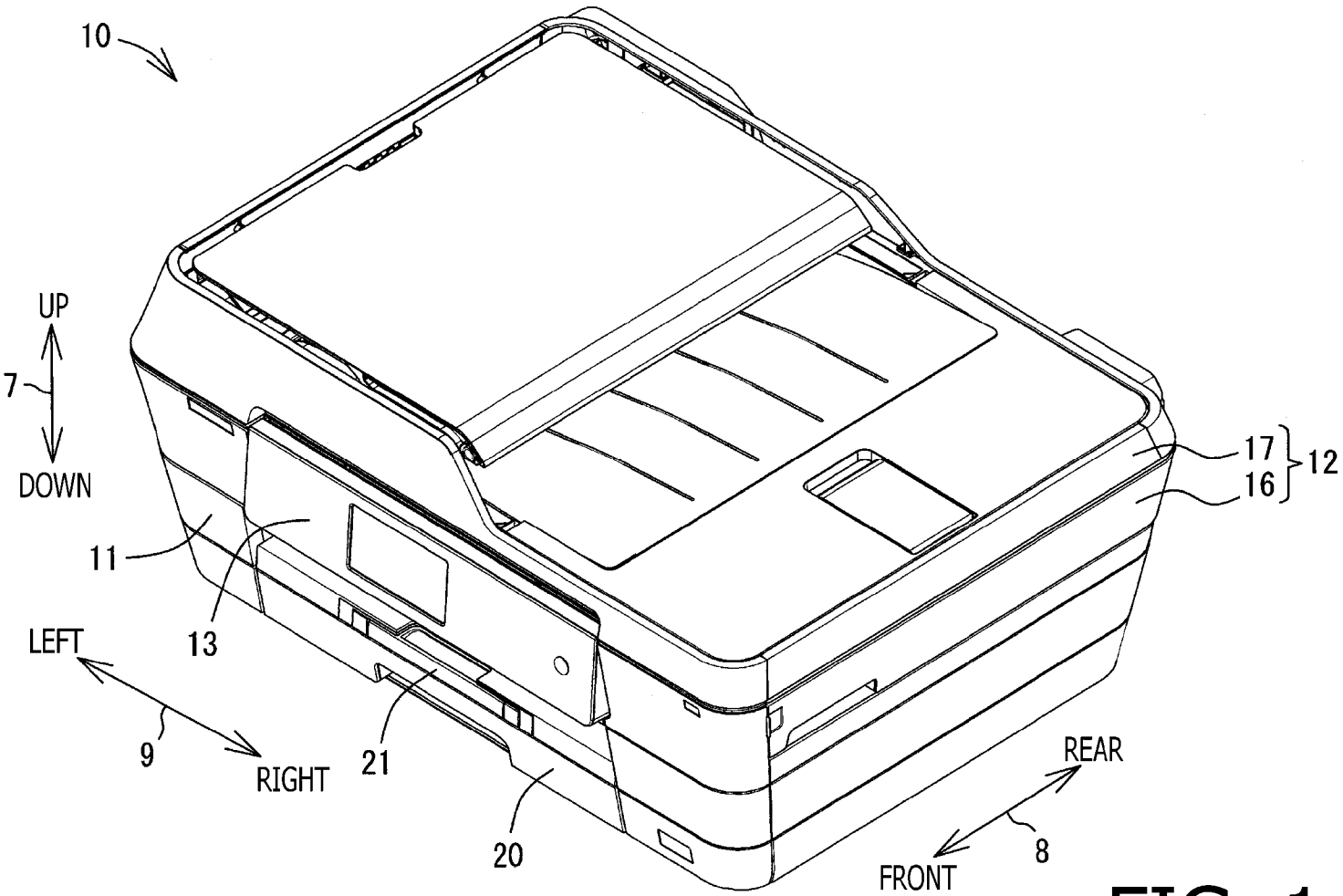
FIG. 1 is a perspective view of an MFD 10, with a scanner casing 12 in a proximate position, according to an embodiment of the present invention with a scanner casing 12 in a proximate position.

In the following description, it is noted that a vertical direction 7 is defined with reference to an up-to-down or down-to-up direction for the MFD 10 in an ordinarily usable posture (see FIG. 1). In other words, the up-to-down or down-to-up direction in FIG. 1 is the vertical direction 7. Further, other directions concerning the MFD 10 will be referred to based on the ordinarily usable posture of the MFD 10: a viewer's lower-left side in FIG. 1, on which an operation panel 13 appears, is defined to be a front side of the MFD 10, and a side opposite from the front side, i.e., a viewer's upper-right side, is defined as a rear side of the MFD 10. A front-to-rear or rear-to-front direction is defined as a direction of depth and may be referred to as a front-rear direction 8. An upper-left side in FIG. 1, which comes on the user's left-hand side with respect to the MFD 10 when the user faces the front side, is referred to as a left side or a left-hand side. Aside opposite from the left, which is on the viewer's lower-right side, is referred to as a right side or a right-hand side. A right-to-left or left-to-right direction of the MFD 10 may also be referred to as a right-left direction 9 or a widthwise direction 9. The directions shown in FIGS. 2-10A, 10B, 10C correspond to those indicated by the arrows appearing in FIG. 1.

[Overall Configuration of the MFD 10]

The MFD 10 is a multi-functional device having a plurality of functions, including a printing function and a scanning function, integrally. As depicted in FIG. 1, the MFD 10 has an overall shape of a six-sided rectangular box and includes a printer casing 11 and a scanner casing 12 which is arranged on top of the printer casing 11. The operation panel 13, having manipulation buttons and a liquid crystal display (unsigned), is arranged on the front face of the MFD 10, or more specifically, on a front face of the printer casing 11.

The printer casing 11 accommodates a printer unit 14. The printer unit 14 records an image on a recording sheet 19 being conveyed from a feeder tray 20 and ejects the recording sheet 19 with the recorded image thereon in a discharge tray 21. The feeder tray 20 and the discharge tray 21 are detachably attached to the printer casing 11 through an opening (unsigned) formed on the front face of the printer casing 11. Detailed configuration of the printer unit 14 will be described later.

[Scanner Casing 12]

The scanner casing 12 accommodates an image reading unit 16 being a flatbed scanner (FBS) and an auto document feeder (ADF) 17 arranged on top of the image reading unit 16. The scanner casing 12 is arranged in an upper position with respect to the printer casing 11 and is movable with respect to the printer casing 11.

The image reading unit 16 includes a piece of contact glass (not shown), on which an original sheet to be read is placed, and a contact image sensor (CIS) unit (not shown), which is movable to reciprocate underneath the contact glass. The CIS unit includes an image sensor (not shown), which can read an image recorded on the original sheet being placed on the contact glass or being conveyed by the ADF 17.

The ADF 17 is pivotably supported by the image reading unit 16 and is movable between a proximate position (see FIG. 1), in which the ADF 17 faces the contact glass arranged on top of the image reading unit 16, and a separate position (not shown), in which the ADF 17 is separated from the image reading unit 16 and exposes the contact glass. The ADF 17 conveys the original sheet placed on an original tray (not shown) to a readable position in the CIS unit and ejects the original sheet, of which recorded image is read by the CIS unit, to a discharge tray (not shown).

Figure 3:
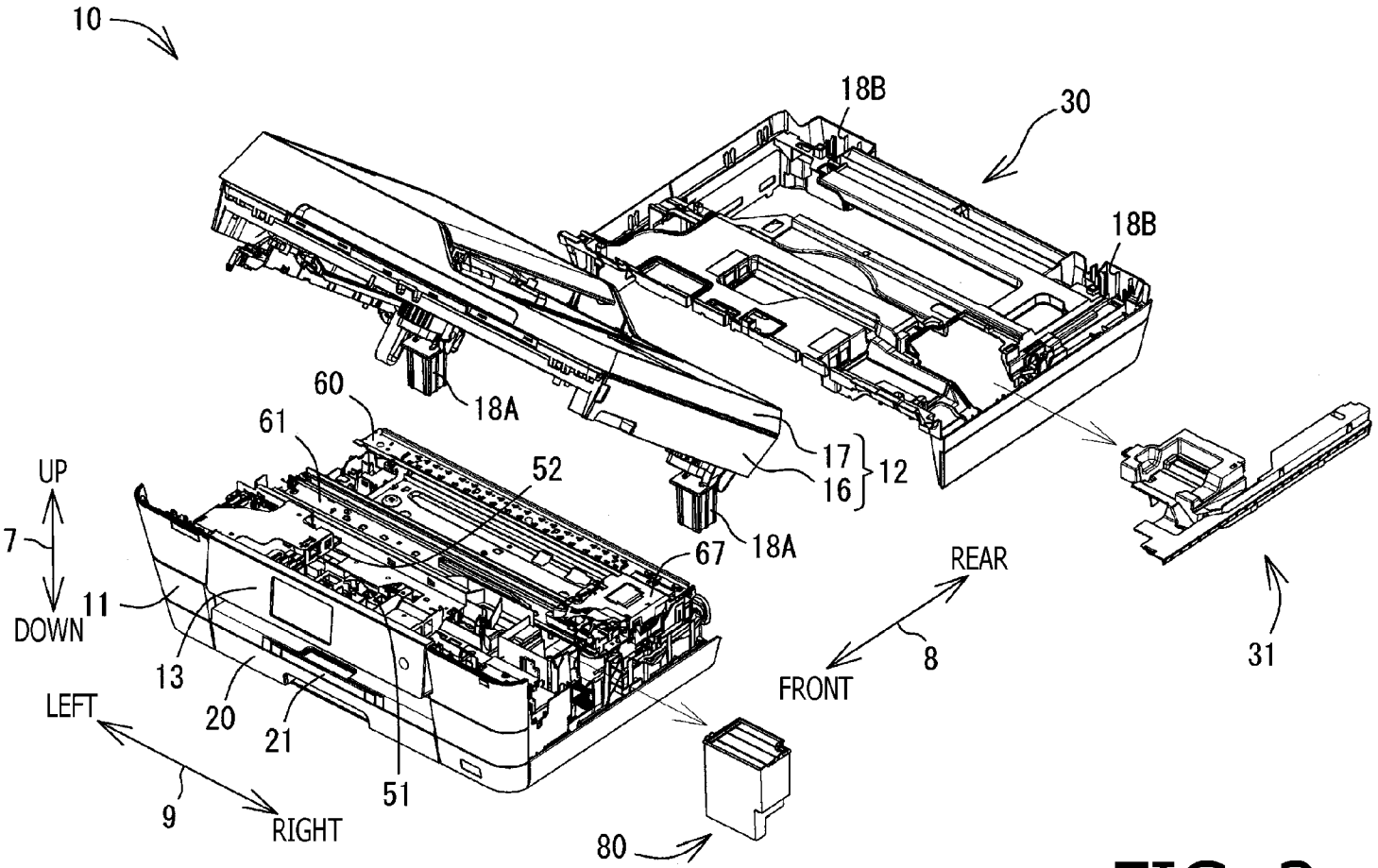
FIG. 3 is an exploded view of the MFD 10 according to the embodiment of the present invention.

As depicted in FIG. 3, the printer casing 11 is open upward at a top thereof, and at least a part of the opening is covered by a first cover 30 and a second cover 31. Inside the printer casing 11, parts constituting the printer unit 14, including paired guide rails 60, 61, a carriage 67, a waste ink tank 80, and terminals 51, 52, are arranged.

The paired guide rails 60, 61 are arranged along the widthwise direction 9 to be spaced apart from each other along the front-rear direction 8 and supported by a frame (not shown) on a rear side of the printer casing 11. The carriage 67 is arranged over the guide rails 60, 61 and movable to reciprocate on the guide rails 60, 61 along the widthwise direction 9. The waste ink tank 80 is removably supported by the printer casing 11 at a right-side end position in the printer casing 11 and in a central area along the front-rear direction 8. Thus, the carriage 67 reciprocates along a direction in parallel with the widthwise direction 9 at the position separated from the waste ink tank 80. The terminals 51, 52 are arranged on a front side along the front-rear direction 8 and on a left-hand side along the widthwise direction 9 in the printer casing 31 to orient rightward, i.e., toward the second cover 31.

The top of the printer casing 11 is partly covered with the first cover 30, but some part of the top of the printer casing 11 is not covered with the first cover 30. In particular, at least an upper area with respect to the waste ink tank 80 is not covered with the first cover 30. Meanwhile, the area not covered with the first cover 30, that is, the area above the waste ink tank 80, is covered with the second cover 31. The second cover 31 is detachably attached to the first cover 30. Still, the top of the printer casing 11 has an uncovered part, which is covered with neither the first cover 30 nor the second cover 31. In particular, an area extending along the widthwise direction 9 at a rear side of the printer casing 11 (i.e., an area in which the recording sheet 19 being conveyed passes through) is covered neither with the first cover 30 nor the second cover 31 but remains uncovered and to be open upward.

Figure 2:
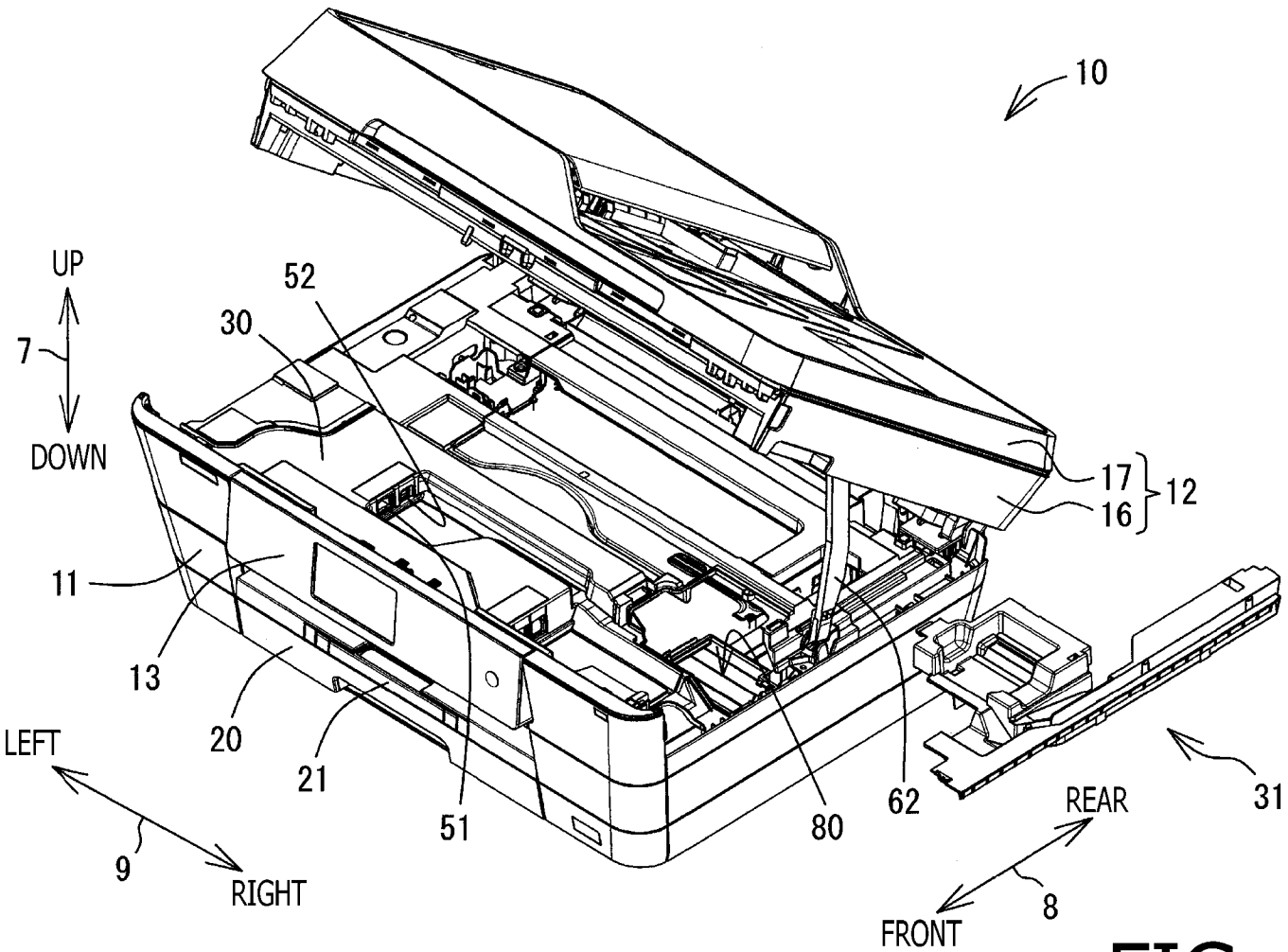
FIG. 2 is perspective view of the MFD 10, with the scanner casing 12 in a separate position, according to the embodiment of the present invention with the scanner casing 12 in a separate position.

As depicted in FIG. 2, the waste ink tank 80 is arranged in the area, which is not covered with the first cover 30 but is covered with the second cover 31. Therefore, by removing the second cover 31 from the first cover 30, a user can access the waste ink tank 80. Thus, the waste ink tank 80 is attachable to the printer casing 11 from above and movable upwardly to be detached from the printer casing 11. While the second cover 31 is attached to the first cover 30, and the waste ink tank 80 is placed in the printer casing 11 through the second cover 31, the waste ink tank 80 can be fixed to a correct position in the printer casing 11.

On a rear end of the scanner casing 12, hinges 18A, one on each widthwise end, are disposed along the widthwise direction 9. Meanwhile, on a rear end of the first cover 30, hinge supports 18B, one on each widthwise end, are formed in positions coincident with the hinges 18A. When the hinges 18A are attached to the hinge supports 18B, the scanner casing 12 is pivotably supported by the first cover 30 to pivot about an axis, which extends along the widthwise direction 9.

More specifically, the scanner casing 12 is pivotable to move between a proximate position (see FIG. 1), in which the scanner casing 12 is adjacent to a top plane of the printer casing 11 (more specifically, to top planes of the first cover 30 and the second cover 31), and a separate position (see FIG. 2), in which the scanner casing 12 is separated from the top plane of the printer casing 11. When the scanner casing 12 is in the separate position, the scanner casing 12 is in an area above the waste ink tank 80, more specifically above a covering piece 32 (see FIG. 8) of the second cover 31, to be separated from the top plane of the printer casing 11 to be in a position higher than the waste ink tank 80. The covering piece 32 of the second cover 31 will be described later in detail.

The proximate position of the scanner casing 12 refers to a condition, in which a bottom plane of the scanner casing 12 faces a top plane of the printer casing 11, and space formed in between the two planes is inaccessible from outside of the MFD 10. In other words, by placing the scanner casing 12 in the proximate position, the second cover 31 is restricted from being removed from the first cover 30.

In the present embodiment, the top plane of the printer casing 11 and the bottom plane of the scanner casing 12 are arranged to contact each other at least partially, and the printer casing 11 supports the scanner casing 12 from below. When the scanner casing 12 is in the proximate position, the printer casing 11 and the scanner casing 12 are in contact with each other at outer rims thereof. In this regard, however, it is not necessary that the outer rim of the printer casing 11 is entirely in contact with the entire outer rim of the scanner casing 11, and vice versa as long as the scanner casing 11 is substantially proximate to the printer casing 11 so that the space in between the two casings 11, 12 is inaccessible from the ambient outside the MID 10. In other words, a small amount of clearance, which is substantially small to prevent the in-between space from being accessed, may be allowed.

The separate position of the scanner casing 11 refers to, on the other hand, a condition, in which the top plane of the printer casing 11 and the bottom plane of the scanner casing 12 are separated from each other, and the space between the printer casing 11 and the scanner casing 12 are accessible by the ambient outside the MFD 10. Therefore, by placing the scanner casing 12 in the separate position, the second cover 31 becomes accessible to a user and can be removed from the first cover 30. In the present embodiment, when the scanner casing 12 is pivoted to be separated from the printer casing 11 approximately at 45 degrees with respect to the printer casing 11, the user standing in front of the MFD 10 can access the space formed in between the printer casing 11 and the scanner casing 12.

As depicted in FIG. 2, a support member 62 is disposed on the right-hand side of the MFD 10 in a position between the printer casing 11 and the scanner 12, when the scanner casing 12 is in the separate position. The support member 62 is a bar, which is coupled to the printer casing 11 at one end and to the scanner casing 12 at the other end. The support member 62 holds the scanner casing 12 in the separate position on the printer casing 11 and restricts the scanner casing 12 from pivoting to return to the proximate position by its weight. The support member 62 may not necessarily be disposed on the right-hand side of the MFD 10 but may be disposed, for example, on the left-hand side of the MFD 10.

The support member 62 is coupled to the printer casing 11 at a rearward position with respect to a space, in which the waste ink tank 80 is accommodated. In other words, the waste ink tank 80 is supported by the printer casing 11 in a frontward position in the printer casing 11 with respect to a coupled position of the support member 62 with the printer casing 11.

The printer casing 11 accommodates a control unit (not shown), which controls behaviors of the printer unit 14. On the other hand, the scanner casing 12 accommodates a control unit (not shown) to control behaviors of the image reading unit 16 and the ADF 17. Each control unit includes a substrate and electric components mounted on the substrate. The control units are electrically connected with each other by cables.

Figure 4:
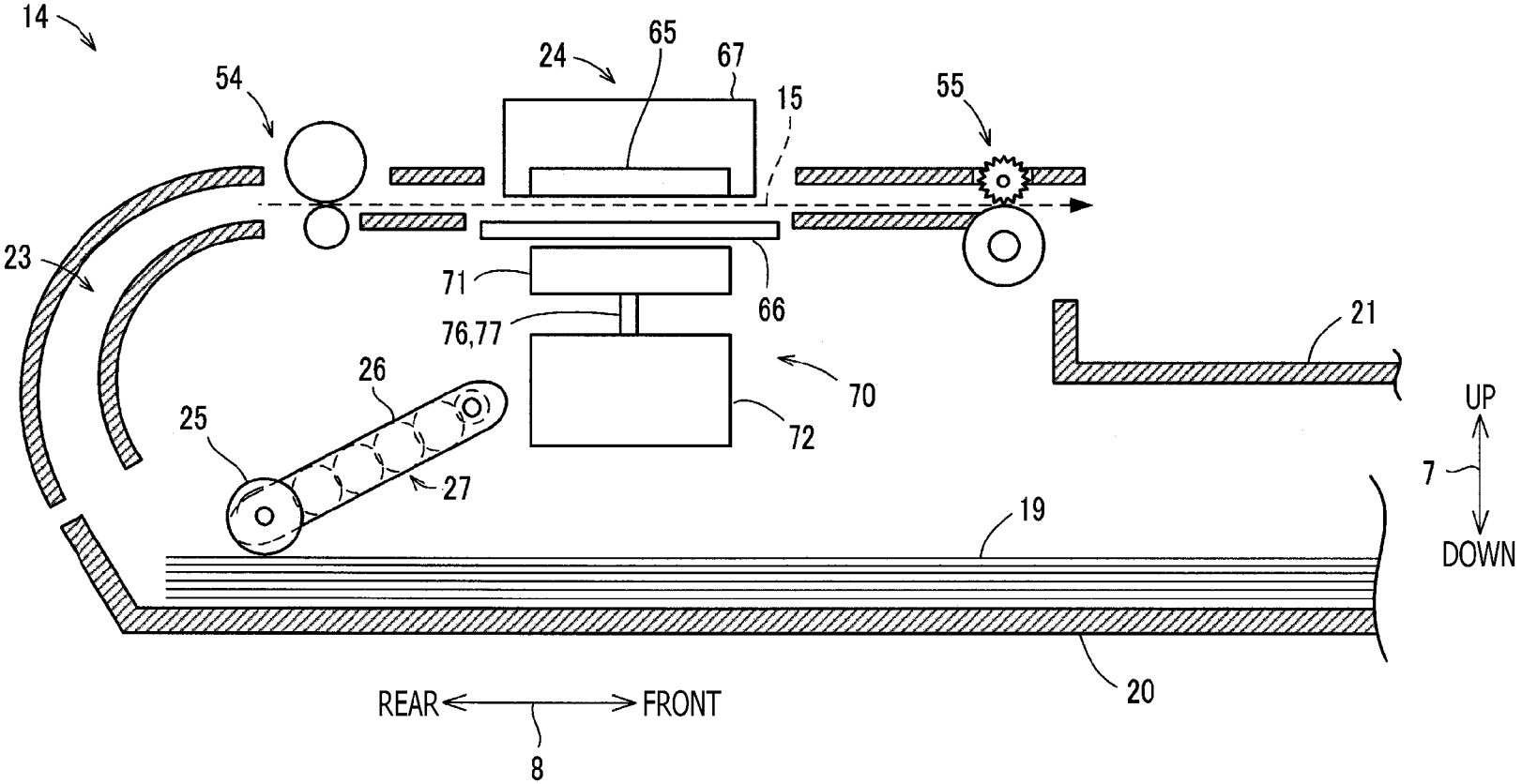
FIG. 4 is a cross-sectional view of a printer casing 11 showing an internal structure of the printer casing 11 in the MFD 10 according to the embodiment of the present invention.

As depicted in FIG. 4, a feed roller 25 is arranged inside the printer casing 11 in an upper position with respect to the feeder tray 20. The feed roller 25 is rotatably attached to one end of a feeder arm 26, which is movable upward and downward to be closer to and farther from the feeder tray 20. The feed roller 25 is rotatable by a driving force, which is transmitted from a feed motor (not shown) via a transmission mechanism 27 including a plurality of gears. When the feed roller 25 pressed against the recording sheet 19 in the feeder tray 20 rotates, the recording sheet 19 is fed in a conveyer path 23 along with the rotation.

The conveyer path 23 rises from a rear end of the feeder tray 20 and curves upper-frontward in the printer casing 11 to extend from the rear side of the casing 11 to the front side. The conveyer path 23 is formed in a widthwise central position inside the printer casing 11. A pair of conveyer rollers 54 and a pair of discharge rollers 55 are arranged on the conveyer path 23. The pair of conveyer rollers 54 and the pair of discharge rollers 55 nip and convey the recording sheet 19 along a conveying direction 15. The conveyer path 23 extends through a nipping position between the paired conveyer rollers 54, a lower position with respect to the recording unit 24, and a nipping position between the paired discharge rollers 55 to reach the discharge tray 21. The recording sheet 19 picked up from the feeder tray is guided along the curvature upwardly in the conveyer path 23 to be turned in a cross-sectional shape of "U" and reaches the lower position of the recording unit 24, in which an image is recorded on the recording sheet 19, and is discharged on the discharge tray 12.

The recording unit 24 records images on the recording sheet 19 conveyed along the conveying direction 15 in the conveyer path 23 in the inkjet recording method. The recording unit 24 includes a recording head 65 and the carriage 67. Further a platen 66 is disposed in a position opposite from the recording unit 24 across the conveyer path 23, i.e., in a lower position with respect to the conveyer path 23. The platen 66 spreads along an entire movable area of the carriage 67 (i.e., an entire widthwise area along the conveyer path 23), in which the carriage 67 reciprocates, and supports the recording sheet 19 being conveyed in the conveyer path 23 from below.

The carriage 67 is disposed in an upper position with respect to the conveyer path 23. The carriage 67 is moved by a driving force, which is from a carriage driving motor (not shown) and transmitted by a belt driving mechanism (not shown), to reciprocate along the widthwise direction 9 on the guide rails 60, 61. The recording head 65 is mounted on the carriage 67. The recording head 65 is arranged on a bottom plane of the carriage 67 to be exposed downwardly and to face the platen 66 across the conveyer path 23. While the carriage 67 reciprocates along the widthwise direction 9, the recording head 65 discharges ink droplets selectively toward the recording sheet 19 placed on the platen 66. Thus, an image is recorded on the recording sheet 19.

As depicted in FIG. 5A, a bottom plane 68 of the recording head 65 is formed to have a plurality of nozzles 69C, 69M, 69Y, and 69B. According to the present embodiment, the nozzle 69C discharges cyan-colored (C) ink, the nozzle 69M discharges magenta-colored (M) ink, the nozzle 69Y discharges yellow-colored (Y) ink, and the nozzle 69B discharges black-colored (B) ink. Each of the nozzles 69C, 69M, 69Y, 69B includes a plurality of nozzles, which align along the front-rear direction 8. Thus, the recording head 65 selectively discharges the inks onto the recording sheet 19 through the nozzles 69C, 69N, 69Y, 69B,

[Purging Unit 70]

A purging unit 70 shown in FIG. 5B is disposed in a lower position with respect to a moving path of the recording head 65 and in a rightward position with respect to a right-side end of the platen 66. In the present embodiment, the position of the purging unit 40 is in a rightward position with respect to an image-recordable reciprocating range of the recording head 65, in which the recording head 65 reciprocates when the image is recorded on the recording sheet 19, and is called a purging position. Thus, the purging unit 70 is disposed in the purging position, which is within a reciprocating range of the carriage 67 but is unoccupied or not interfered with by the recording sheet 19 being conveyed. In other words, the purging unit 70 is disposed in the purging position, which is on the outside (e.g., the right-hand side) of the conveyer path 23 along the widthwise direction 9. It is noted in FIG. 5B that the waste ink tank 80 is shown in an illustrative purpose, in order to illustrate the connection between the purging unit 70 and the waste ink tank 80 via tubes 76, 76; however, the waste ink tank 80 shown in FIG. 5B may not necessarily indicate a correct positional relation with respect to the other components. In other words, the waste ink tank 80 may not necessarily be arranged in the upper position with respect to the carriage 67 or the purging unit 70.

The purging unit 70 includes a movable part 71, a cam mechanism 72 to move the movable part 71 along the vertical direction 7, the tubes 76, 77 for ink to pass there-through, and a pump 73 to suck the ink. The purging unit 70 manipulates the ink to be discharged through the nozzles 69C, 69M, 69Y, 69B of the recording head 65 and conveys the discharged ink to the waste ink tank 80 through the tubes 76, 77. In the following description, the ink discharged through the nozzles 69C, 69M, 69Y, 69B by the purging unit 70 will be referred to specifically as waste ink in order to distinguish from the ink to be discharged to record the image through the nozzles 69C, 69M, 69Y, 69B onto the recording sheet 19.

The movable part 71 includes rubber-made caps 74, 75. The caps 74, 75 are arranged in positions to vertically face the bottom plane 68 of the recording head 65 in the purging position along the vertical direction 7. The cam mechanism 72 is driven by a cam driving motor (not shown) and moves the movable part 71 along the vertical direction 7. When the movable part 71 is moved upward, the caps 74, 75 become in contact with the bottom plane 68 of the recording head 65. In this regard, the cap 74 covers the nozzle 69B, and the cap 75 covers the nozzles 69C, 69M, 69Y. The caps 74, 75 are connected with ends of the tubes 76, 77 respectively. The tubes 76, 77 are resin-made flexible tubes.

In intermediate positions in the tubes 76, 77, a pump 73 is disposed. The pump 73 may be, for example, a rotary-typed tube pump, which can be driven by a pump driving motor (not shown). The pump 73 is in communication with a sealed space between the bottom plane 68 and the caps 74, 75 via the tubes 76, 77. When the pump 73 is driven while the caps 74, 75 seal the nozzles 69C, 69M, 69Y, 69B, negative pressure is created in areas inside the caps 74, 75, and the ink remaining in the nozzles 69C, 69M, 69Y, 69B flow to be discharged in the caps 74, 75. The discharges waste ink is conveyed to the waste ink tank 80 through the tubes 76, 77.

The tubes 76, 77 are, as depicted in FIG. 6, laid out from the purging unit 70 rearward with respect to the printer casing 11 and extended frontward along an extending path, which is arranged on the right-hand side of the printer casing 11, to be connected to connector parts 83, 84 of the waste ink tank 80. Meanwhile, the printer casing 11 is formed to have restrictive parts 63, 64, which are formed along the extending path of the tubes 76, 77 in positions adjacent to the tubes 76, 77 in the extending path. The restrictive parts 63, 64 may contact the tubes 76, 77 from above at positions below the connector parts 83, 84. The restrictive part 63 may contact the tubes 76, 77 in the extending path at a position closer to the waste ink tank 80 rather than the purging unit 70. Meanwhile, the restrictive part 64 may contact the tubes 76, 77 in the extending path at a position closer to the purging unit 70 rather than the waste ink tank 80.

[Waste Ink Tank 80]

The waste ink tank 80 includes, as depicted in FIG. 7, an enclosure 81. The enclosure 81 has a shape of an approximately rectangular box, which encompasses an inner space to contain the waste ink. Inside the enclosure 81, an ink absorber 82 is accommodated. On an outer side surface of the enclosure 81, the connector parts 83, 84 are formed. The waste ink tank 80 is, as depicted in FIG. 6, disposed in the printer casing 11 to have the outer side surface with the connector parts 83, 84 facing rearward. In this regard, the printer casing 11 holds the enclosure 81 of the waste ink tank 80 at least from below. Thus, the enclosure 81 is arranged in the printer casing 11.

The enclosure 81 is open at a top thereof. In other words, the enclosure 81 forms an opening, having edges 85, 86, 87, 88, at the top thereof. On the edges 85, 86, which extend along the front-rear direction 8 and face each other along the widthwise direction 9, paired protrusions 89A, 89B to protrude upward are formed respectively. The paired protrusions 89A are formed in spaced apart positions from each other along the front-rear direction 8, and the paired protrusions 89B are formed in spaced apart positions from each other along the front-rear direction 8. The paired protrusions 89A are formed in frontward positions, i.e., positions closer to the edge 87, on the edge 85 along the front-rear direction 8. Meanwhile, the paired protrusions 89B are formed in substantially central positions on the edge 86 along the front-rear direction 8. Thus, the paired protrusions 89A and the paired protrusions 89B are in displaced positions from each other along the front-rear direction.

The ink absorber 82 is placed in and removed out of the enclosure 81 through the opening formed on top of the enclosure 81. The ink absorber 82 is made of a porous material, such as foamed polyurethane. The waste ink conveyed to the inner space of the enclosure 81 through the tubes 76, 77 and the connector parts 83, 84 enters pores in the ink absorber 82 to be absorbed by the ink absorber 82. Moisture in the waste ink evaporates and exits out of the enclosure 81 through the opening formed on top of the enclosure 81. Meanwhile, the edge 85 is provided with an cave 90 overhanging toward the edge 86 and extending along the front-rear direction 8. Thus, with the cave 90, a distance between the edges 85, 86 is smaller than a width of the inner space inside the enclosure 81, in other words, the cave 90 narrows the opening on top of the enclosure 81 to be narrower than the width of the inner space inside the enclosure 81. Therefore, the ink absorber 82 accommodated in the inner space inside the enclosure 81 is prevented from falling off from the enclosure 81 unintentionally.

The connector parts 83, 84 are formed to protrude outward from a rear side of the enclosure 81 and are formed to have tubular shapes with through-holes (not shown), which connects the inner space inside the enclosure 81 and the ambience surrounding the enclosure 81. Therefore, when the tubes 76, 77 are attached to the connector parts 83, 84 to fit around outer circumferences of the connector parts 83, 84, spaces inside the tubes 76, 77 are in communication with the inner space inside the enclosure 81. Thus, the waste ink sucked by the purging unit 70 is conveyed in the tubes 76, 77 to flow into the inner space in the enclosure 81. A dimension of outer diameters of the connector parts 83, 84 is substantially smaller than an inner diameter of the tubes 76, 77. Therefore, the tubes 83, 84 are attachable to the connector parts 83, 84 rather easily. On tip ends of the tubes 76, 77 attached to the connector parts 83, 84 respectively, fastening members 91 (see FIG. 7) are attached. In FIG. 7, however, the tube 76 and the fastening member 91 to be attached on the tube 76 are omitted. The fastening member 91 will be described later in detail.

[Second Cover 31]

As depicted in FIG. 8, the second cover 31 is a substantially fiat piece, of which dimension along the vertical direction 7 is smaller than dimensions along the widthwise direction 9 and the front-rear direction 8. The second cover 31 includes the covering piece 32, which has an approximate shape of square in a plane view when viewed from above, and a guiding piece 33, which has an elongated shape being longer along the front-rear direction 8 than the widthwise direction 9. The covering piece 32 extends leftward from a front part of the guiding piece 34. In other words, the guiding piece 33 extends along the front-rear direction 8 at a right-side end of the covering piece 32. The covering piece 32 and the guiding piece 33 are formed integrally. The covering piece 32 and the guiding piece 33 are formed to have fit-in claw 37, and fit-in claws 38, which are to be fitted into the first cover 30, respectively. The fit-in claw 37 in the covering piece 32 is formed on a left-side end of the covering piece 32. The fit-in claws 38 in the guiding piece 33 are formed on front-side end and on a right-side end of the guiding piece 33 respectively.

With the fit-in claws 37, 38 fitted in the first cover 30, the second cover 31 is attached to the first cover 30. Thereby, the area above the waste ink tank 80 is covered by the second cover 31, while the waste ink tank 80 is held inside the printer casing 11. By releasing the fit-in claws 37, 38 from the first cover 30, the second cover 31 can be removed from the first cover 30 while the first cover 30 is maintained attached to the printer casing 11. Thereby, the area above the waste ink tank 80 is exposed, and the waste ink tank 80 can be removed from or attached to the printer casing 11 while the first cover 30 is maintained attached to the printer casing 11.

With the second cover 31 being attached to the first cover 30, the covering piece 32 is arranged in a position to face an upper plane of the waste ink tank 80. In this regard, a part of the covering piece 32 facing the ink absorber 81 in the waste ink tank 80 is dented downward. In other words, a lower plane of the covering piece 32 protrudes downward at the pan facing the ink absorber 81. Meanwhile, on an upper plane of the guiding piece 33, a guide groove 34 is formed to accommodate cables 57, 58. The guide groove 34 guides the cables 57, 58 connected to the terminals 51, 52 to the outside of the printer casing 11. More specifically, the cables 57, 58, which are connected to the terminals 51, 52 at one ends, enter a front part of the guide groove 34 from a left-hand side and bended rearward to exit the printer casing 11 through a rear end (a position in a vicinity of the hinges 18A) of the printer casing 11 to the outside.

The guide groove 34 is formed to dent downward with respect to a top portion of the second cover 31 and includes a first groove 34A, which extends along the widthwise direction 9, and a second groove 34B, which extends along the front-rear direction 8. The first groove 34A is open at a left-side end thereof to be continuous with a guide groove (not shown) formed in the first cover 31. A right-side end of the first groove 34A is continuous with a front end of the second groove 34B, and the guide groove 34 is angled at the point where the first groove 34A meets the second groove 34B. The second groove 34B extends to the rear end of the printer casing 11 and is closed thereat. The second groove 34B in the present embodiment is a three-sided groove formed with a bottom plane and a sidewall formed in the guiding piece 33 and a sidewall formed in the first cover 30. In one embodiment, the guiding piece 33 may be omitted from the second cover 31.

As depicted in FIG. 9, on a lower plane of the part of the covering piece 32 in the second cover 31 facing the waste ink tank 80, ribs 35, 36 are formed. The ribs 35, 36 are formed with plate-like pieces having surfaces extending along the widthwise direction 9 and orthogonally to the front-rear direction 8. When the second cover 13 is attached to the first cover 30, the rib 35 protruding downward is placed in between the paired protrusions 89A and contacts the edge 85 at a lower end thereof, and the rib 36 protruding downward is placed in between the paired protrusions 89B and contacts the edge 86 at a lower end thereof. In this regard, an additional rib (not shown) to contact ink absorber 82 may be formed on the lower plane of the covering piece 32, and the cave 90 may be omitted.

[Fastening Members 91]

In the following description, the fastening member 91 attached to the tube 77, representing the fastening members 91, will be described. It is to be noted that the fastening member 91 attached the tube 76 is identical to the fastening member 91 attached to the tube 76.

As depicted in FIGS. 10A-10C, the fastening member 91 is a string of wire curved at a plurality of positions. The fastening member 91 includes an annular portion 92, a handle portion 93, and an engageable portion 94, and is attached to an outer circumference of the tube 77, which is fitted around the connector part 84. The annular portion 92 is curved in a round shape to form a ring. The handle portion 93 is formed with one and the other ends of the wire, extending from one side of the annular portion 92, crossing over each other. The engageable portion 94 is formed with a part of the wire extending from the other side of the annular portion 92. The engageable portion 94 is extended toward the tip end of the tube 77 (i.e., the tip end being fitted around the connector part 84) and turned around toward the annular portion 92.

In FIGS. 10A and 10B, the annular portion 92 is in a condition, where an inner diameter thereof is smaller than an outer diameter of the tube 77 being attached to the connector part 84. In the present embodiment, the condition of the annular portion 92 shown in FIGS. 10A and 10B will be referred to as a neutral condition. When the fastening member 91 is attached to the tube 77 with the annular portion 77 being in the neutral condition (see FIG. 10C), the annular portion 77 contracts to tighten the tube 77, in this regard, the inner diameter of the annular portion 92 in the neutral condition is substantially smaller than the outer diameter of the connector part 84. Meanwhile, the connector part 84 is made of a resin, which may be the same resin material as the enclosure 81; therefore, even with the fastening member 91 attached to the tube 77 fitted around the connector part 84, the through-hole formed inside the connector part 84 is prevented from being closed by the annular portion 77. With the fastening member 91, the tube 77 is pressed tightly against the outer circumference of the connector part 84 and is in communication with the inner space inside the enclosure 84 through the connector part 84.

The handle portion 93 is handled by the user when the user attaches the fastening member 91 to the tube 77 and removes the fastening member 91 from the tube 77. The one and the other ends of the fastening member 91 forming the handle portion 93 are moved toward each other, the ring of the annular portion 92 is expanded. The condition of the expanded annular portion 92 will be referred to as an expanded condition. Thus, through the handle portion 93, the annular portion 92 is transitive between the neutral condition, in which the inner diameter thereof is smaller than the outer diameter of the tube 77, and the expanded condition, in which the inner diameter thereof is greater than the outer diameter of the tube 77.

The engageable portion 91 is a part of the wire containing parts curved in approximate shapes of "U." More specifically, as shown in FIG. 10C, the engageable portion 94 may contain a plurality of parts: a linear part continuous from the annular portion 92 extending linearly toward the tip end of the tube 77 along an outer surface of the tube 77; a curved part continuous from the linear part being curved to extend over a rim of the opening of the tube 77 (i.e., the tip end of the tube 77), with an inner side of the curved part contacting the rim, to be drawn inside the through-hole of the tube 77; and a turn-around part continuous from the curved part being turned around toward the annular portion 92 along the inner surface of the tube 77. With the engageable portion 94, more specifically, with the turn-around part inserted in the through-hole of the tube 77, the fastening member 91 can be placed in a correct position along a longitudinal direction of the tube 77. When the fastening member 91 is attached to the tube 77, the turned-around part, which is continued to the annular portion 92, is spaced apart from the annular portion 92. Therefore, when the fastening member 91 is attached to the tube 77, the engageable portion 94 arranged inside the tube 77 is in a position closer to the tip end of the tube 77 with respect to a fastening position of the tube 77, where the annular portion 92 tightens the tube 77.

The fastening member 91 described above may be attached to the tube 77 in a procedure described below. Firstly, while the annular portion 92 is placed in the expanded condition by an expanding force from the user through the handle portion 93, the tip end of the tube 77 may be threaded through the ring of the annular portion 92 from a side opposite from the engageable portion 94 toward the engageable portion 94. The tube 77 may be pushed with respect to the fastening member 91 to a position, in which the tip end thereof contacts the inner side of the curved part of the engageable portion 94. Secondly, while the expanded condition of the annular portion 92 is maintained, the tube 77 may be fitted around the connector part 84. Finally, the handle portion 93 may be released from the expanding force so that the annular portion 92 tends to be in the neutral condition. Thus, the tube 77 may be fastened tightly to the connector part 84.

Effects of the Embodiment

According to the embodiment described above, the waste ink tank 80 is replaced with another waste ink tank 80 by moving the scanner casing 12 from the proximate position to the separate position and removing the second cover 31 from the first cover 30. If, for example, the waste ink tank 80 is covered solely by the first cover 30, it may be necessary that the cable extended between the printer casing 11 and the scanner casing 12 is disconnected, the scanner casing 12 is removed from the first cover 30, and the first cover 30 is removed from the printer casing 11 before the waste ink tank 80 is removed. In order to carry out all these works, the user may require an extra work area around the MFD 10. According to the embodiment described, above, however, it is not necessary that the MFD 10 is moved, nor the cables are disconnected. Therefore, the extra work area is not required, and the waste ink tanks 80 may be easily exchanged.

According to embodiment described above, the scanner casing 12 is rotatably supported by the printer casing 11 at the rear end thereof. With this structure, it may be natural that the user reaches a hand to access the waste ink tank 80 through the front ends of the scanner casing 12 and the printer casing 11. Therefore, with the waste ink tank 80 arranged in the frontward position in the printer casing 11 with respect to the support member 62, it may be prevented that the user is interfered with by the support member 62 while the waste ink tank 80*s* are exchanged.

According to embodiment described above, when the scanner casing 12 is placed in the separate position, a space, of which height is greater than the height of the waste ink tank 80, is created in the position above the waste ink tank 80. Therefore, the waste ink tank 80 may be moved upward into the space securely without being tilted. Thus, the waste ink tank 80 may be easily removed from the printer casing 11, and leakage of the waste ink through the open top of the enclosure 81 may be prevented.

According to embodiment described above, with the restrictive parts 63, 64 being placed in the upper positions with respect to the tubes 76, 77 to be contacted by the tubes 76, 77, the tubes 76, 77 may be restricted from being pulled upward for a larger amount by the waste ink tank 80 from operable positions in the extending path when the waste ink tank 80 is moved upward to be removed out of the printer casing 11. In other words, the tubes 76, 77 may be pulled upward by the waste ink tank 80 only for a necessary amount but are restricted from being pulled further upward from the restrictive parts 63, 64. Therefore, when a new waste ink tank 80 is placed in the printer casing 11, the user's works to place the tubes 76, 77 back into the operable positions in the extending path may be reduced. Further, with the restrictive parts 63, 64 contacting the tubes 76, 77 at the positions lower than the connector parts 83, 84 of the waste ink tank 80, it is likely that the tip ends of the tubes 76, 77 orient upward when the waste ink tank 80 is moved upward to be removed. Accordingly, leakage of the waste ink from the open-ended tubes 76, 77 may be prevented. In this regard, the restrictive part 63 being closer to the waste ink tank 80 serves even more effectively to prevent the leakage than the restrictive part 64, which is farther from the waste ink tank 80 compared to the restrictive part 63. Although in FIG. 6 the restricting parts 63, 64 are shown the positions to be apart from the tubes 76, 77, which are in the operable positions in the extending path, the restrictive parts 63, 64 may be formed in lower positions to be in contact with the tubes 76, 77 in the operable positions in the extending path.

According to embodiment described above, with the fastening members 91, the tubes 76, 77 are tightly fitted around the outer circumferences of the connector parts 83, 84. Therefore, when the MFD 10 is in use or moved, leakage of the waste ink through the connected parts between the tubes 76, 77 and the waste ink tank 80 may be prevented. Further, even when the tubes 76, 77 are removed from the connector parts 83, 84, the fastening members 91 stay on the tubes 76, 77 and plug the tubes 76, 77 to block the remaining waste ink from leaking. Therefore, even when the waste ink tank 80 is removed, or when the tubes 76, 77 unintentionally fall from the connector parts 83, 84, leakage of the remaining waste ink out of the tubes 76, 77 may be restricted.

Having said that, it may be difficult to perfectly avoid the leakage from occurring. In consideration of the risk of leakage, in the present embodiment, the cables 57, 57 connected to the terminals 51, 52 are supported in the guide groove 34 which is formed on the upper plane of the second cover 31. With this structure, it is necessary to remove the cables 57, 58 before the second cover 31 is removed. Thus, the cables 57, 58 may be securely prevented from being tainted by the waste ink, which may leak when the waste ink tank 80 is exchanged. The cables 57, 58 may be, but not limited to, LAN cables or modular cables.

According to embodiment described above, the position of the waste ink tank 80 or the enclosure 81 is defined by the printer casing 11 and the second cover 31. Therefore, by being placed in the printer casing 11, the enclosure 81 is restricted from moving downward. Meanwhile, by being placed to contact the ribs 35, 36 of the second cover 31, the enclosure 81 is restricted from moving upward. Further, with the ribs 35, 36 being placed in the position between the paired protrusions 89A and the paired protrusions 89B respectively, the enclosure 81 is restricted from moving along the front-rear direction 8. Furthermore, with the paired protrusions 89A and the paired protrusions 89B being in the displaced positions with respect to each other along the front-rear direction 8, the enclosure 81 is restricted from being rotated on a horizontal plane. Thus, the enclosure 81 is securely prevented from being tilted, and the leakage of the waste ink when the MFD 10 is moved may be prevented.

[Modifications]

Although an example of carrying out the invention has been described, those skilled in the art will appreciate that there are numerous variations and permutations of the inkjet recording apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the rotation axis of the scanner casing 12 may not necessarily be arranged at the rear end of the printer casing 11 along the widthwise direction 9 but may be arranged in an arbitrary position. For another example, the scanner casing 12 may not necessarily be rotatable with respect to the printer casing 11. The scanner casing 12 may be vertically movable in parallel with the scanner casing 12 along the vertical direction 7 or may be slidable with respect to the printer casing 11 along the front-rear direction 8 or the widthwise direction 9. In other words, the scanner casing 12 may be movable with respect to the printer casing 11 in any direction as long as the scanner casing 12 is movable between a position, in which the scanner casing 12 covers the second cover 31 (i.e., a proximate position), and a position, in which the scanner casing 12 exposes the second cover (i.e., a separate position).

For another example, the waste ink tank 80 may not necessarily be connected with the purging unit 70. The present embodiment may be applied to a waste ink tank, which is disposed in a position to face the bottom plane 68 of the recording head 65 within the movable range of the carriage 68 to catch and contain the waste ink discharged through the nozzles 69C, 69M, 69Y, 69B without recording an image. The behavior of the recording head 65 to discharge the ink through the nozzles 69C, 69M, 69Y, 69B without recording an image may be known as "flushing."

For another example, the two paired protrusions 89A, 89B may not necessarily be formed on the edges 85, 86, which extend in parallel with each other. The paired protrusions 89A, 89B may be formed on edges, which extend orthogonally with respect to each other. For example, the paired protrusions 89A may be formed on the edge 85 in positions spaced apart from each other, and another paired protrusions (not shown) may be formed on the edge 87 extending orthogonally to the edge 85 along the front-rear direction 8 in spaced apart from each other.

For another example, the scanner casing 12 may not necessarily accommodate the image reading unit 16 or the ADF 17 but may contain a data receiver unit, which may receive data wirelessly from an external device (not shown) through a short-distance wireless communication such as infrared communication of Bluetooth (registered trademark) interface.

What is claimed is:

1. An inkjet recording apparatus, comprising:

a first casing having an upward opening at a top thereof;

a recording unit disposed in the first casing and configured to discharge ink from a nozzle onto a sheet;

a first cover configured to cover a part of the opening of the first casing;

a second cover detachably attached to the first cover and configured to cover another part of the opening which is not covered by the first cover;

a waste ink tank removably supported by the first casing at a position facing the second cover in the first casing and configured to contain waste ink discharged from the nozzle; and a second casing disposed in an upper position with respect to the first casing and configured to be movably supported by the first cover, the second casing being movable between a proximate position, in which the second casing is adjacent to top planes of the first cover and the second cover, and a separate position, in which the second casing is separated from the top planes of the first cover and the second cover.

2. The inkjet recording apparatus according to claim 1, wherein the recording unit comprises:

a carriage configured to reciprocate along a predetermined direction at a position separated from the waste ink tank; and a recording head mounted on the carriage and comprising a nozzle surface, on which the nozzle is formed;

wherein the first casing comprises:

a cap configured to cover the nozzle surface at a position, which is within a reciprocating range of the carriage and is unoccupied by the sheet;

a purge unit configured to be in communication with the cap and to purge the waste ink through the nozzles;

a tube connected with the purge unit and the waste ink tank, and configured to let the waste ink purged by the purge unit pass there-through;

a restrictive part disposed along an extending path of the tube extending in between the purge unit and the waste ink tank and configured to be in contact with the tube at a lower position with respect to a connected position, in which the tube is connected with the waste ink tank, from above.

3. The inkjet recording apparatus according to claim 2, wherein the restrictive part is disposed along the extending path at a position closer to the waste ink tank than the purge unit.

4. The inkjet recording apparatus according to claim 1, wherein the second casing in the separate position is separated from the second cover and placed in a position above the second cover and higher than a height of the waste ink tank.

5. The inkjet recording apparatus according to claim 1, wherein the second casing is rotatably supported by the first cover at a first side, which defines an upper plane of the first casing;

wherein the first casing comprises a supporting member, which is coupled to the first casing at a coupled position between the first side and a second side opposite from the first side and to the second casing, the supporting member being configured to support the second casing in the separate position;

wherein the waste ink tank is disposed in a position closer to the second side of the first casing with respect to the coupled position of the support member and the first casing.

6. The inkjet recording apparatus according to claim 1, wherein the first casing comprises a terminal, to which a cable is electrically connected;

wherein a guide groove to accommodate the cable and to guide the cable to outside of the first casing is formed on an upper plane of the second cover.

7. The inkjet recording apparatus according to claim 1, wherein the waste ink tank comprises:

an enclosure comprising a connector part, the connector part being configured to be fitted with an end of the tube and to connect an inner space inside the enclosure with the tube fitted with the connector part, the enclosure being formed to have an upward opening at a top thereof; and an absorber accommodated in the inner space inside the enclosure and configured to absorb the waste ink flowing into the inner space from the tube through the connector part.

8. The inkjet recording apparatus according to claim 7, wherein the enclosure is disposed in the first casing, and an edge forming the opening of the enclosure is in contact with a rib, which is formed to protrude from a lower plane of the second cover.

9. The inkjet recording apparatus according to claim 8, wherein the edge forming the opening comprises a first edge and a second edge, the first edge and the second edge extending along a first direction and facing each other along a second direction orthogonal with respect to the first direction;

wherein a first pair of protrusions, which are separated from each other along the first direction, are formed on the first edge;

wherein a second pair of protrusions, which are separated front each other along the first direction, are formed on the second edge in positions displaced from the first pair of protrusions along the first direction;

wherein a first rib and a second rib, each of which has a surface extending along the first direction, are formed on the lower plane of the second cover;

wherein the first rib is configured to contact the first edge at a position between the first pair of protrusions, and the second rib is configured to contact the second edge at a position between the second pair of protrusions.

10. The inkjet recording apparatus according to claim 7, wherein the waste ink tank comprises a fastening member, the fastening member comprising:

an annular portion formed by a string in a shape of a ring and configured to be attached to an outer circumference of the tube being fitted with the connector part; and a handle portion formed with one and the other ends of the string crossing over each other; and wherein the fastening ember is transitive between a neutral condition, in which an inner diameter of the annular portion is smaller than an outer diameter of the tube, and an expanded condition, in which the inner diameter of the annular portion is expanded to be greater than the outer diameter of the tube by the one and the other ends of the string in the handle portion being moved toward each other.

11. The inkjet recording apparatus according to claim 10, wherein the fastening member further comprises an engageable portion, which is extended from the annular portion toward the end of the tube and inserted inside the tube at the end of the tube and turned around inside the tube toward the annular portion.

12. The inkjet recording apparatus according to claim 1, wherein the second casing comprises an image reader unit configured to read an image recorded on the sheet.

* * * * *